United States Patent [19]

Gies

[11] 4,296,675

[45] Oct. 27, 1981

Best Available Copy

[54] CYLINDER CUSHION WITH CONTRACTABLE RING

[75] Inventor: Paul E. Gies, Jackson, Mich.

[73] Assignee: Aeroquip Corporation, Jackson, Mich.

[21] Appl. No.: 57,598

[22] Filed: Jul. 16, 1979

[51] Int. Cl.[3] ..... F15B 15/22

[52] U.S. Cl. ..... 91/396; 91/26; 277/218

[58] Field of Search ..... 91/396, 395, 394, 25, 91/26; 92/8 S B; 277/218, 216

[56] References Cited

U.S. PATENT DOCUMENTS

| | | | |
|---|---|---|---|
| Re. 24,532 | 9/1958 | Halladay et al. | 91/394 |
| 1,963,725 | 6/1934 | Teetor | 277/218 |
| 1,999,466 | 4/1935 | Leonard | 277/218 |
| 2,493,602 | 1/1950 | Sterrett | 91/396 |
| 2,591,920 | 4/1952 | Colvin | 277/216 |
| 2,970,023 | 1/1961 | Thompson | 277/216 |
| 3,440,930 | 4/1969 | Olson | 91/396 |
| 3,677,141 | 7/1972 | Lagerquist | 91/394 |

FOREIGN PATENT DOCUMENTS

| | | | |
|---|---|---|---|
| 2254495 | 5/1974 | Fed. Rep. of Germany | 91/394 |
| 2424975 | 12/1975 | Fed. Rep. of Germany | 91/394 |

*Primary Examiner*—Paul E. Maslousky
*Attorney, Agent, or Firm*—Beaman & Beaman

[57] ABSTRACT

A fluid pressure actuator consisting of piston structure reciprocal within a cylinder pressurized through ports at the cylinder ends wherein cushioning means is mounted upon the piston structure controlling the flow of fluid through the ports producing controlled piston deceleration at the termination of its stroke. The port utilizes sealing means in the form of a radially expandable and contractable sealing ring floatably mounted to permit limited radial and axial movement. The seal ring closely engages, in a telescoping manner, the outer cylindrical surface of a valve member mounted upon the piston structure wherein a very accurate and effective seal occurs between the ring and valve member, and bleeding of the cylinder chamber being exhausted can be accurately regulated by predetermined flow control apparatus such as slots, orifices or adjustable needle valves. The seal ring is radially split or flexible having a normal inner diameter slightly less than the outer diameter of the valve member wherein the ring inner diameter will automatically be reduced as wear occurs between the seal ring and valve member, and dimensional variations due to wear are automatically compensated.

6 Claims, 5 Drawing Figures

CYLINDER CUSHION WITH CONTRACTABLE RING

BACKGROUND OF THE INVENTION

Fluid actuators such as expansible motors utilizing cylinders and reciprocal pistons defining chambers alternately pressurized and exhausted of fluid medium commonly use cushioning means to control deceleration of the piston movement as the piston approaches the cylinder head. Cushioning permits large pressurized fluid medium volumes and pressures to be utilized to produce rapid piston movements and high force capacities without imposing damage upon the piston structure due to hammering or impact of the piston structure with the actuator heads at the termination of piston movement in a given direction. Cushioning apparatus lengthens the fluid actuator life, reduces the noise attendant with actuator operation and increases the working life of the components being driven by the actuator.

The most common fluid actuator piston cushion structure utilizes a fluid port defined in the actuator head coaxial with the piston axis. This port communicates with the source of fluid pressure, and the fluid exhaust conduit or reservoir, selectively, through appropriate valve devices. The cushioning apparatus normally comprises a valve member mounted upon the piston structure coaxial with the piston axis and the valve member either circumscribes the piston rod, on the rod end of the piston, or constitutes a projection or button on the other side of the piston coaxial with the rod axis. It is usually desired that cushioning occur at the termination of piston movement in either direction with double acting expansible motors, and in most expansible motors valve members are utilized on both piston sides.

Valve members mounted upon piston structure for cushioning purposes are telescopingly received within the ports defined within cylinder heads through which the pressurized medium is introduced or exhausted from the cylinder chamber. Seal rings and the like are often utilized within the head port for cooperating with the valve member, such as shown in U.S. Pat. Nos. 2,493,602 and 2,704,996. Also, it is known to form the cushion sealing means in such a manner, or support the seal ring in such a manner, as to permit the seal to be self aligning with respect to the piston mounted valve member as shown in the assignee's U.S. Pat. Nos. 2,719,510 and Re. 24,532.

The presence of the valve member within the head port restricts the flow of pressurized medium through that port when it is desired to pressurize the adjacent cylinder chamber and it is common to utilize axially movable valve member seal rings and bypass passages permitting fluid to flow around the seal ring and valve member when pressurizing the cylinder chamber as shown in U.S. Pat. Nos. 2,853,974, 2,935,047 and 3,267,815.

As the fluid medium is being exhausted from the cylinder chamber forward of the piston movement the entrance of the "leading" valve member into its aligned head port rapidly restricts the rate of fluid flow being exhausted to achieve the desired cushioning and piston movement deceleration, and the valve member seal ring port structure will operate to close bypass passages used during pressurization, and control the rate at which the fluid medium is exhausted during the final stages of piston movement. The rate of piston movement during the final stages of cushioning may be controlled by adjustable needle valves as shown in U.S. Pat. Nos. 2,704,996, 2,719,510 and Re. 24,532, or the fluid may be metered through grooves or slots defined in the valve structure itself, as shown in U.S. Pat. Nos. 3,008,454 and 3,704,650, and in some fluid actuator constructions a plurality of radial orifices defined within tubular valve members progressively decrease the rate that the fluid medium may be exhausted as the piston approaches the adjacent head, as shown in U.S. Pat. Nos. 2,443,312, 3,677,141 and 3,974,910.

Valve member seal rings located within head ports are usually of an elastic material and subject to wear. As fluid actuators are often expected to cycle several million times during their effective life the wear occuring between the valve members and the seal rings gradually permit the exhausting fluid medium to increasingly escape between the surfaces of the valve member and associated seal ring, and as the fluid medium pressures during cushioning may reach very high values leakage due to wear can become significant, and the efficiency of the cushioning apparatus with known cushioning constructions rather rapidly deteriorates. Because of wear effective cushioning over long periods of time, particularly at high fluid pressures and with speed actuators, cannot be maintained and prior art devices have not effectively solved the problem of deterioriating piston cushioning characteristics.

It is an object of the invention to provide cushioning structure for fluid actuators wherein the efficiency of piston cushioning is maintained over long periods of time and through many cycles of operation and wherein consistent cushioning characteristics are maintained despite wide fluid temperature variations.

An additional object of the invention is to provide wear compensating piston cushioning means which is usable with a variety of cushion embodiments, and wherein the improved cushioning structure is of economical manufacture and does not require expensive modifications to existing apparatus, and may be utilized with conventional forms of fluid actuators.

In the practice of the invention the cushioning structure includes a valve member, or members, mounted upon a fluid actuator piston reciprocal within a cylinder enclosed at its ends by heads. The valve members have cylindrical exterior surfaces and are adapted to be telescopically received within bores or ports defined in the cylinder heads. The head ports communicate with passages and conduits wherein pressurized fluid medium may be introduced into the cylinder chambers via the ports, and fluid medium is also exhausted from the cylinder chambers through the ports by the moving piston during a stroke. Valve and control structure, well known in the art, determines the fluid medium circuit exterior of the fluid actuator.

The port includes an annular seal receiving recess or chamber concentric to the piston axis and adjacent the interior head surface. The seal chamber includes an annular seal ring having an outer diameter less than the diameter of the chamber whereby limited radial displacement of the seal ring is possible to permit the seal ring to be radially self-aligning with the associated valve member. Seal ring retaining means, such as a snap ring, are located within the seal ring chamber to axially restrain ring movement toward the piston chamber, and an annular radial shoulder or abutment defines the outermost axial dimension of the seal ring chamber and abuttingly engages a side of the seal ring during cushioning. The axial dimension between the abutment shoulder and snap ring is greater than the axial dimension of the seal ring whereby limited axial movement of the seal ring occurs during pressurization and exhaust cycles. Fluid medium bypass passages are defined in the head and communicate with the seal ring chamber and the cylinder chamber whereby fluid may flow around the seal ring during pressurization of the cylinder chamber through the port.

The seal ring is preferably formed of cast iron and has excellent wear resistant characteristics. The seal ring is split, i.e., is severed or broken at one location through its radial dimension wherein the circumference of the ring may be expanded. The normal I.D. of the inner surface of the seal ring is slightly less than the O.D. of the outer surface of the associated valve member, and the valve member is provided with ring expanding surfaces, whereby entrance of the valve member into the seal ring I.D. slightly expands the seal ring to provide an effective tight sealed relationship, yet permits the relative axial movement between the valve member and ring required. In practice, the seal ring is initially manufactured with an I.D. which would have an interference fit with the associated cushion member. The seal ring is then radially fractured and installed, and the larger diameter of the valve member will cause the seal ring to slightly expand each time it is received therein.

The dimensional relationship between the seal ring and valve member permits the seal ring to automatically compensate for wear occuring between the valve member and seal ring, and an effective sealing relationship will exist between the ring inner surface and valve member outer surface for an extended time. As wear occurs the degree of expansion of the seal ring will slowly decrease and the frictional engagement between the seal ring and valve member will remain substantially constant.

The contractable seal ring described above can be utilized with cushion systems employing bypass and needle valve bleeding systems, and the sealing ring may also be employed with the valve members having slots or grooves defined in the outer surface for fluid flow purposes. Also, the contracting seal ring may be employed with valve members having radial orifices communicating with an internal passage and the advantages thereof will be utilized with all of the aforementioned cushion systems.

BRIEF DESCRIPTION OF THE DRAWINGS

The aforementioned advantages and objects of the invention will be appreciated from the following description and accompanying drawings wherein:

With reference to FIG. 1, a typical fluid actuator or expansible motor is illustrated consisting of a cylinder 10 having its ends closed by heads 12 and 14 maintained upon the cylinder ends by tie rods 16. Piston structure including a piston 18 is reciprocally mounted within the cylinder and includes a piston rod 20 extending through head 12 through gland 22. The head 12 is provided with a fluid passage 24 communicating with threaded port 26, while passage 28 formed in head 14 is provided with threaded port 30. Conventional fittings and conduits, such as hose, not shown, are attached to the threaded ports for connecting the fluid actuator with a source of pressurized medium, and a reservoir to which the medium may be exhausted. The passages 24 and 28 are coaxial with the axis of the piston rod 20, and respectively communicate with annular chambers 32 and 34 adjacent the inner face of the associated head in which they are formed. The bores and the chambers define ports selectively receiving the piston mounted cushion apparatus, and except for size, the cushion apparatus on each side of the piston 18 is identical, and only one of the cushion chambers and ports need by described.

Figure 1:
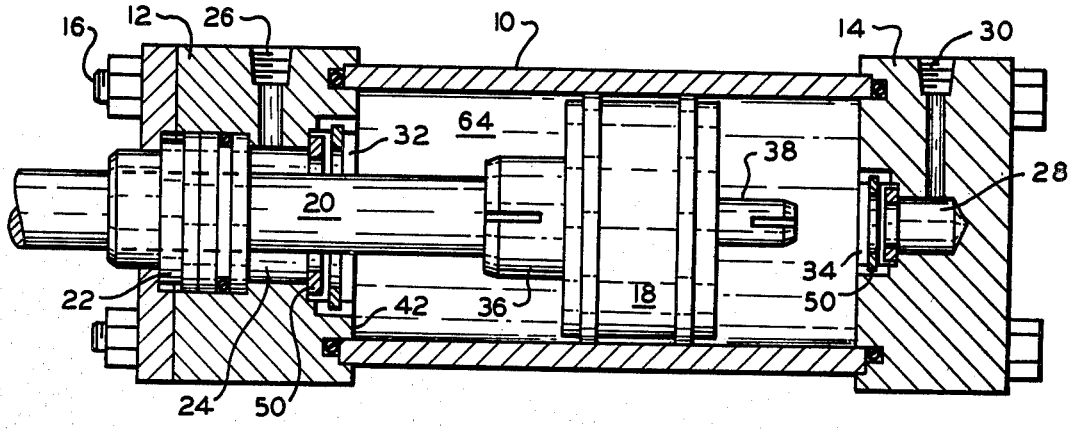
FIG. 1 is an elevational, diametrical, sectional view of a fluid actuator utilizing cushion structure in accord with the invention.

The cushion apparatus includes an annular valve member 36 circumscribing the piston rod 20 located adjacent the piston 18, and the opposite side of the piston includes the valve member 38 which constitutes a cylindrical projection coaxial with the piston rod. Each of the valve members is of a basic cylindrical form, and is rigidly affixed to the piston 18 for movement therewith. In the embodiments shown in FIGS. 1–3 the valve members are provided with bleed grooves 40 through which cushioned pressurized medium flows during the final stages of cushioning, the the grooves 40 being of a contoured configuration with respect to the axis of the piston rod wherein the cross sectional area of the grooves decreases as the piston approaches the adjacent head.

Figure 2:
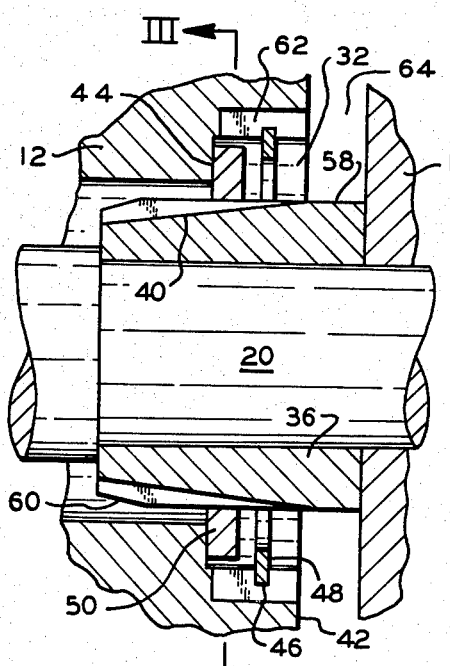
FIG. 2 is an enlarged, detail, elevational, diametrical view of cushion structure in accord with the invention illustrating a valve member received within the seal ring.

With reference to FIG. 2, the port chamber 32 is of a cylindrical configuration having an outer diameter and intersecting the inner face 42 of the head 12. The outer axial dimension of the chamber 32 is defined by the radial abutment shoulder 44 which is of a planar configuration perpendicularly disposed to the piston rod axis, an annular groove 46 is defined in the chamber for receiving the seal ring retaining snap ring 48.

Figure 4:
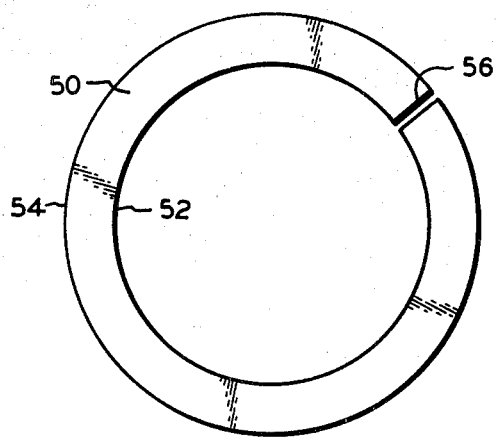
FIG. 4 is an elevational view of a seal ring in accord with the invention, the split in the periphery being exaggerated for purpose of illustration.

Sealing between the valve member 36 and the port chamber 32 is achieved by the annular seal ring 50. The seal ring 50, FIG. 4, is of a circular configuration having an inner diameter 52, an outer diameter 54, and the seal ring is radially severed at 56 by fracturing, sawing, or other fabrication technique. In the commercial embodiment, the seal ring 50 is formed of cast iron, and the separation 56 is defined by fracturing the ring periphery in a radial manner. Cast iron, or wrought iron, has the advantage of excellent wear characteristics, capability of being accurately machined and sized, and may be accurately severed by fracturing in a economical manner. However, it will be appreciated that the seal ring may be formed of other rigid material, preferably metal, which may be accurately sized and has long wearing characteristics. The material of the seal ring must be such that the seal ring is not compressible even under high fluid medium pressures, and must not be susceptible to deformation due to fluid medium pressure.

The diameter of the valve member outer surface 58 is slightly greater than the "normal" diameter of the seal ring inner surface 52. For instance, prior to severing the seal ring 50 at 56, the diameter of the inner surface 52 is sufficiently less than diameter of the valve member surface 58 that an interference fit would occur if the valve member was forced into the seal ring. The several thousandths of an inch difference between the diameters of the valve member and seal ring produce this interference fit, and because the seal ring is severed at 56 the ability of the seal ring to circumferentially expand when the valve member 36 is inserted thereinto produces a close sliding fit, rather than an interference fit.

The valve members 36 and 38 each include a "front" end which initially approaches the associated seal ring, and the valve members are provided with a conical seal ring expanding surface 60 intersecting the front edge and outer diameter. Thus, as the valve member enters the associated seal ring 50 the expanding surface 60 will engage the seal ring and expand the same as the valve member enters the seal ring.

As will be appreciated from FIG. 2, the diameter of the seal ring outer surface 54 is less than the port chamber diameter wherein the seal ring may "float" in a radial direction to line itself with the valve member 36 under the influence of the expanding surface 60. Of course, the difference in diameter between the seal ring and port chambers is not sufficient to permit the seal ring to become so misaligned with respect to the valve member that the expanding surface will not "lift" the seal ring to an aligning position.

Figure 3:
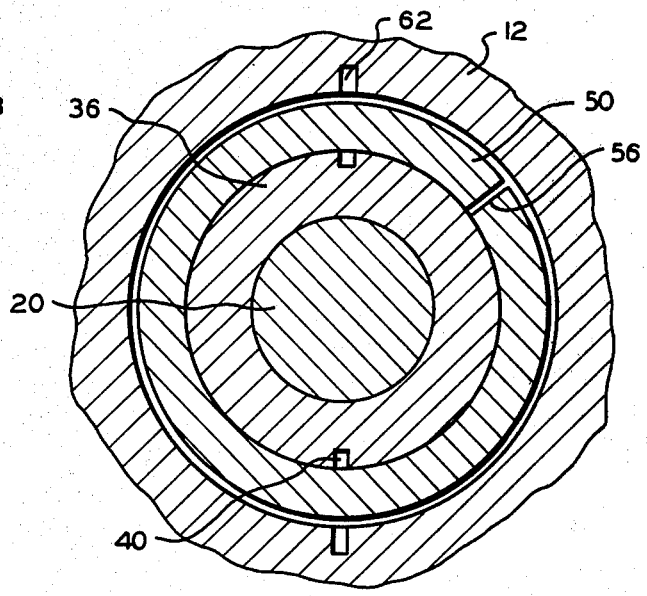
FIG. 3 is an elevational, sectional view taken along Section III—III of FIG. 2.

Also, as will be noted from FIG. 3, the axial thickness of the seal ring 50 is substantially less than the axial dimension separating the port chamber shoulder 44 and the snap ring 48. Thus, the seal ring is capable of axial movement between the extreme left position shown in FIG. 2 where the seal ring is engaging the shoulder 44, and an extreme movement to the right where the seal ring would be engaging the snap ring 48. A plurality of bypass passages or slots 62 are formed in the head 12 intersecting the head face 42 and port chamber 32. Thus, when the sealing ring 50 is in engagement with the snap ring 48, fluid may flow through the passages 62 into the cylinder chamber 64 to displace the piston 18 toward the right, and this flow, plus the flow of fluid through the bleed grooves 40, will permit adequate pressurized medium to enter the chamber 64 to rapidly move the piston to the right, and once the valve member 36 is withdrawn from the sealing ring 50 a full flow of pressurized medium may enter chamber 64.

During cushioning, assuming the piston 18, piston rod 20 and valve member 36 to be moving toward the head 12, the build up of fluid pressure within chamber 64, and the rapid flow of pressurized medium through the port chamber 32, will force the seal ring 50 against the abutment shoulder 44. As soon as the valve member 36 sufficiently approaches head 12 the surface 60 will be received within the seal ring inner diameter 52, align the seal ring with the valve member, and permit the valve member to be telescopically slidingly received within the seal ring. During this relationship of the seal ring and valve member exhausted fluid is bled from the chamber 64 through grooves 40, and fluid may not pass through the bypass passages 62 as engagement of the seal ring 50 with the abutment shoulder 44 prevents such flow. The close sliding fit between the seal ring inner diameter and the valve member prevents leakage between these components, and the fact that the seal ring is engaging the shoulder 44 permits only an insignificant loss of fluid through the seal ring split 56.

As wear occurs between the seal ring 50 and valve member 36 such wear is automatically compensated by the fact that the seal ring has been expanded from its normal diameter and the resiliency of the metal of the seal ring tends to maintain the seal ring at its minimum diameter wherein no clearances exist at the ring ends at the severed location 56. Thus, significant automatic wear compensation is provided assuring uniform cushioning characteristics over an extended period of time.

Figure 5:
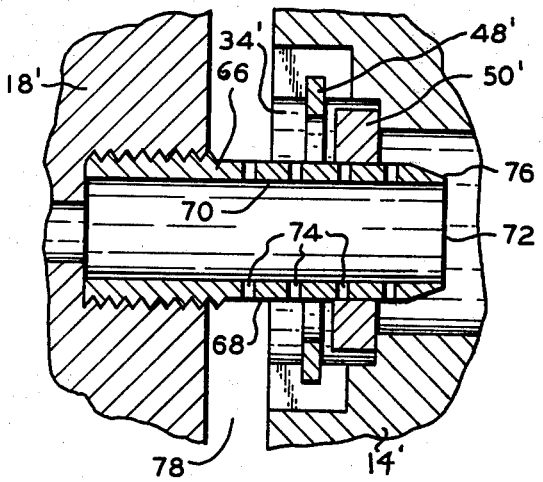
FIG. 5 is an enlarged, detail, diametrical sectional view of an embodiment of cushion apparatus in accord with the invention illustrating a tubular valve member.

In FIG. 5, a variation of valve member is disclosed. In this embodiment the valve member 66 mounted upon the non-rod side of the piston 18' comprises a tubular form threadedly connected to the piston coaxial with the piston rod. The head 14', port chamber 34' and seal ring components are identical to those previously described and are indicated by primed reference numerals. The valve member 66 includes an outer cylindrical surface 68, and a passage 70 is internally defined which intersects the valve member end 72. A plurality of radial orifices 74 are axially spaced along the length of the valve member, and conical seal ring expanding surfaces 76 defined at the forward end of the valve member will expand the seal ring 50' as the valve member 66 enters the same. Initially, several orifices 74 will be in communication with the cylinder chamber 78 permitting a greater volume of pressurized medium to flow through the orifices and into the passage 70 during the initial stages of cushioning. As a greater axial length of the valve member enters the seal ring 50' the number of orifices communicating with the chamber 78 reduces slowing piston movement and providing the desired cushioning action. With this embodiment, the automatic wear compensation of the seal ring occurs as previously described, and no modification of the seal ring or port chamber is required regardless of whether a valve member of the type shown in FIG. 1, or FIG. 5 is used.

In the above description the radial expansion of ring 50 is permitted because of the peripheral split. However, it is to be appreciated that the ring 50 could be constructed in such a manner as to permit radial expansion without utilizing a split of the disclosed type, and contracting piston rings which permit such radial variation are known in the piston ring art. Also, it would be possible to use coiled rectangular cross section members which would be capable of the desired radial variation.

The radial contraction and expansion of seal ring 50 results in a much more consistent cushioning performance than with seal rings which are not capable of such expanion of contraction. While a floating ring is tolerant of small deviations of the piston and rod assembly from the common center line due to eccentricities inherent in manufacturing methods and external loading normal to the center line, conventional floating seal rings are not capable of providing the uniformity of cushioning over long periods of time that is achieved by the invention. Cushioning is seriously affected by temperature variations in the fluid, and as wear occurs in the seal ring the decrease in fluid viscosity as the temperature rises significantly affects the cushioning operation. Wear will produce eccentricities within non-expandable and contractable seal rings and wide variation in performance will result due to the inability of conventional seal rings to accommodate for wear. It is to be appreciated that the wear compensating ability of the seal ring provides significant improvements in cylinder cushioning over long periods of operation.

It is appreciated that various modifications to the inventive concepts may be apparent to those skilled in the art without departing from the spirit and scope of the invention.

I claim:

1. A fluid pressure actuator comprising, in combination, a cylinder defining a chamber and having a head provided with a port through which fluid may be admitted to the cylinder or exhausted therefrom, piston structure slidable in said cylinder toward and away from said head, an annular ring of non-compressible material mounted on said head adjacent and substantially coaxial to said port, said ring including annular inner and outer surfaces defining a radial dimension, said ring being severed through said radial dimension whereby the diametrical dimension of said ring may vary between a normal radially contracted diameter and a radially expanded diameter, an elongated valve member mounted on said piston structure telescopingly received within said port and ring when said piston structure is adjacent said head controlling the flow of fluid through said port, said valve member including an outer surface slidingly engaged by said ring inner surface, the normal contracted diameter of said ring inner surface being slightly less than the diameter of said valve member outer surface whereby said ring firmly receives said valve member, ring expanding means defined on said valve member initially engaging and expanding said ring to said expanded diameter upon engagement by said valve member, and ring mounting means mounting said ring upon said head limiting axial movement of said ring and permitting radial contraction and expansion thereof.

2. In a fluid pressure actuator as in claim 1, said ring being formed of metal.

3. In a fluid pressure actuator as in claim 1, said ring being formed of cast iron.

4. In a fluid pressure actuator as in claim 1, said valve member including a front edge adjacent said valve member outer surface initially engaging said ring inner surface as said piston structure approaches said head, said ring expanding means comprising a conical bevel surface defined on said valve member front edge.

5. In a fluid pressure actuator as in claim 1, said valve member comprising an elongated member having an outer cylindrical surface and a leading end disposed toward said port, at least one fluid conducting slot defined in said valve member intersecting said cylinder surface and leading end extending in the direction of the length of said valve member.

6. In a fluid pressure actuator as in claim 5 wherein the transverse cross sectional area of said fluid conducting slot progressively diminishes remotely from said leading end.

* * * * *